US009324469B1

(12) United States Patent
Hamilton

(10) Patent No.: US 9,324,469 B1
(45) Date of Patent: Apr. 26, 2016

(54) X-RAY INTENSIFYING SCREENS INCLUDING MICRO-PRISM REFLECTIVE LAYER FOR EXPOSING X-RAY FILM, X-RAY FILM CASSETTES, AND X-RAY FILM ASSEMBLIES

(71) Applicant: Geraldine M. Hamilton, Spring, TX (US)

(72) Inventor: Geraldine M. Hamilton, Spring, TX (US)

( * ) Notice: Subject to any disclaimer, the term of this patent is extended or adjusted under 35 U.S.C. 154(b) by 0 days.

(21) Appl. No.: 14/530,426

(22) Filed: Oct. 31, 2014

(51) Int. Cl.
*G21K 4/00* (2006.01)

(52) U.S. Cl.
CPC ..... *G21K 4/00* (2013.01); *G21K 2004/06* (2013.01); *G21K 2004/12* (2013.01)

(58) Field of Classification Search
CPC ..... G03C 5/17; G21K 4/00; G21K 2004/06; G21K 2004/12
USPC ..... 250/483.1, 487.1, 484.4; 430/966
See application file for complete search history.

(56) References Cited

U.S. PATENT DOCUMENTS 4,028,550 A * 6/1977 Weiss ..... C09K 11/06 250/483.1
4,225,653 A * 9/1980 Brixner ..... C09K 11/7702 250/483.1
4,835,396 A * 5/1989 Kitada ..... G21K 4/00 250/483.1
4,893,021 A * 1/1990 Bollen ..... G03C 5/17 250/487.1
4,994,355 A * 2/1991 Dickerson ..... G03C 5/17 430/509
4,997,750 A * 3/1991 Dickerson ..... G03C 5/17 430/403
5,021,327 A * 6/1991 Bunch ..... G03C 5/17 250/483.1
5,108,881 A * 4/1992 Dickerson ..... G03C 1/46 430/502
5,162,872 A * 11/1992 Vanasse ..... G01J 3/26 356/519
5,396,350 A * 3/1995 Beeson ..... F21V 5/02 349/62
5,461,660 A * 10/1995 Dooms ..... G21K 4/00 250/487.1
5,533,087 A 7/1996 Snoeren (Continued)

FOREIGN PATENT DOCUMENTS

JP 2011112623 A 6/2011
KR 101264125 B1 5/2013

OTHER PUBLICATIONS

Serman & Singer, "Intensifying Screens, Cassettes, and Screen Films", version publicly available Sep. 14, 2012 according to the Internet Archive Wayback Machine, https://web.archive.org/web/20120914105227/http://www.columbia.edu/itc/hs/dental/sophs/material/screens.pdf.*

(Continued)

*Primary Examiner* — David Porta
*Assistant Examiner* — Blake Riddick
(74) *Attorney, Agent, or Firm* — ALG Intellectual Property, LLC

(57) ABSTRACT

An intensifying screen for exposing X-ray film includes a screen support backing, a luminescent layer having a luminescent material that emits light in the presence of X-rays, and a reflective layer disposed between the luminescent layer and the screen support backing, the reflective layer including a plurality of micro-prisms that reflect light emitted by the luminescent material. An X-ray film cassette includes at least one intensifying screen and a housing surrounding the at least one intensifying screen.

19 Claims, 4 Drawing Sheets

(56) References Cited

U.S. PATENT DOCUMENTS

| | | | | |
|---|---|---|---|---|
| 5,644,193 | A * | 7/1997 | Matsuda | C09K 11/00 252/301.4 R |
| 5,940,998 | A | 8/1999 | Brauer | |
| 5,992,066 | A | 11/1999 | Brauer | |
| 6,120,636 | A * | 9/2000 | Nilsen | B29C 41/26 156/230 |
| 6,167,646 | B1 | 1/2001 | Brauer | |
| 6,178,224 | B1 | 1/2001 | Polichar et al. | |
| 6,737,103 | B2 | 5/2004 | Polichar et al. | |
| 6,907,109 | B2 | 6/2005 | Polichar et al. | |
| 7,400,439 | B2 | 7/2008 | Holman | |
| 2004/0221529 | A1 * | 11/2004 | Zornes | E04B 1/14 52/311.1 |
| 2006/0270773 | A1 * | 11/2006 | Hale | G02B 6/0065 524/423 |
| 2007/0222993 | A1 * | 9/2007 | Linder | G02B 5/20 356/416 |
| 2008/0048102 | A1 * | 2/2008 | Kurtz | H01L 31/0232 250/226 |
| 2009/0146070 | A1 * | 6/2009 | Vieira Da Rocha | G01T 1/2018 250/370.09 |
| 2010/0230327 | A1 * | 9/2010 | Hartrumpf | B07C 5/3425 209/577 |
| 2011/0095442 | A1 * | 4/2011 | Greener | G02B 6/0038 264/1.25 |
| 2011/0194176 | A1 * | 8/2011 | Behrend | A61B 3/0008 359/387 |
| 2012/0064464 | A1 * | 3/2012 | Fitterman | G03C 1/42 430/405 |
| 2012/0140224 | A1 * | 6/2012 | Switkes | G01N 21/78 356/369 |

OTHER PUBLICATIONS

Michette et al., "Active micro-structure arrays for X-ray optics", 2007, Advances in X-ray/EUV Optics and Components II, Proc. SPIE (6705), pp. 670502-1-670502-12.*

A.R. Cowen, et al., The design and imaging characteristics of dynami, solid-state, flat-panel x-ray image detectors for digital fluoroscopy and fluorography, LXi_Research, The University of Leeds, Division of Medical Physics, and Department of Cardiology, Yorkshire Heart Centre, The General Infirmary, Leeds, West Yorkshire, UK, Received Mar. 28, 2008; accepted Jun. 4, 2008, Clinical Radiology (2008) 63, 1073-1085, copyright 2008 The Royal College of Radiologists. Published by Elsevier Ltd.

N.Serman and S. Singer, Intensifying Screens, Cassettes and Screen Films, downloaded from the internet Apr. 29, 2015 at web address http://www.columbia.edu/itc/hs/dental/sophs/material/screen.pdf, Version from Internet Archive, publicly available Sep. 14, 2012, considered.

* cited by examiner

X-RAY INTENSIFYING SCREENS INCLUDING MICRO-PRISM REFLECTIVE LAYER FOR EXPOSING X-RAY FILM, X-RAY FILM CASSETTES, AND X-RAY FILM ASSEMBLIES

BACKGROUND

Intensifying screens are often used in conventional radiography procedures for exposing X-ray films. For example, X-ray films utilizing intensifying screens are used for a variety of diagnosis and treatment procedures in the fields of dentistry and medicine. A conventional intensifying screen may include a polymer backing sheet coated with a phosphor material. The phosphor material converts radiation energy into visible light. An X-ray film used with an intensifying screen typically includes a photographic film that is coated with an emulsion layer that is sensitive to light. Exposure of the X-ray film to visible light results in darkening of the film in areas struck by light rays, thereby producing an image on the film.

While conventional X-ray films utilizing intensifying screens may reduce exposure of patients and medical workers to radiation in comparison with techniques that don't utilize intensifying screens, such as X-ray procedures utilizing direct-exposure X-ray films, further reductions in radiation generation during X-ray procedures are desirable. Continued exposure to doses of radiation over time may lead health problems in patients and medical workers. For example, patients and medical staff exposed to doses of radiation may be at risk of developing various medical conditions due to cumulative radiation exposure. Accordingly, reducing the exposure of patients and medical workers to harmful radiation even further is desirable so as to minimize any health risks associated with radiation exposure. Additionally, it is preferable to maintain high image quality while reducing the amount of radiation used, since reducing the amount the amount of radiation utilized in conventional X-ray technologies often results in a corresponding reductions in image sharpness, clarity, and detail.

SUMMARY

The instant disclosure is directed to exemplary intensifying screens for exposing X-ray film, as well as to X-ray film cassettes and X-ray film assemblies. According to at least one embodiment, an intensifying screen for exposing an X-ray film may comprise a screen support backing, a phosphor layer including a luminescent material that emits light in the presence of X-rays, and a reflective layer disposed between the luminescent layer and the screen support backing, the reflective layer including a plurality of micro-prisms that reflect light emitted by the luminescent material, thereby better utilizing available light to expose the film. Also, this may increase sharpness, clarity, and detail on the film.

According to at least one embodiment, the reflective layer may be configured to reflect light emitted by the phosphor material toward an X-ray film disposed adjacent to the phosphor layer. For example, the reflective layer may reflect light in a direction toward the luminescent layer and/or in a direction generally perpendicular to a surface of the luminescent layer facing the reflective layer.

In some embodiments, the luminescent layer may emit visible light in response to excitation by X-rays. For example, the luminescent material may comprise a phosphor material. The reflective layer may comprise any suitable material, including, for example, a polymer material and/or a crystalline material, such as a glass material. In some embodiments, the intensifying screen may include a light-absorbing layer on a side of the plurality of micro-prisms opposite the luminescent layer. The screen support backing may, for example, comprise a light-absorbing layer.

According to various embodiments, an X-ray film cassette may be configured to accommodate an X-ray film. The cassette may include at least one intensifying screen and a housing surrounding the at least one intensifying screen. For example, the cassette may include a single intensifying screen disposed on an inner surface of the housing, or alternatively, two intensifying screens disposed on opposing inner surfaces of the housing.

In at least one embodiment, an X-ray film assembly may comprise at least one intensifying screen and an X-ray film. The X-ray film may be positioned adjacent to the at least one intensifying screen and may include an emulsion layer. For example, the X-ray film may be disposed between two intensifying screens.

Features from any of the disclosed embodiments may be used in combination with one another in accordance with the general principles described herein. These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
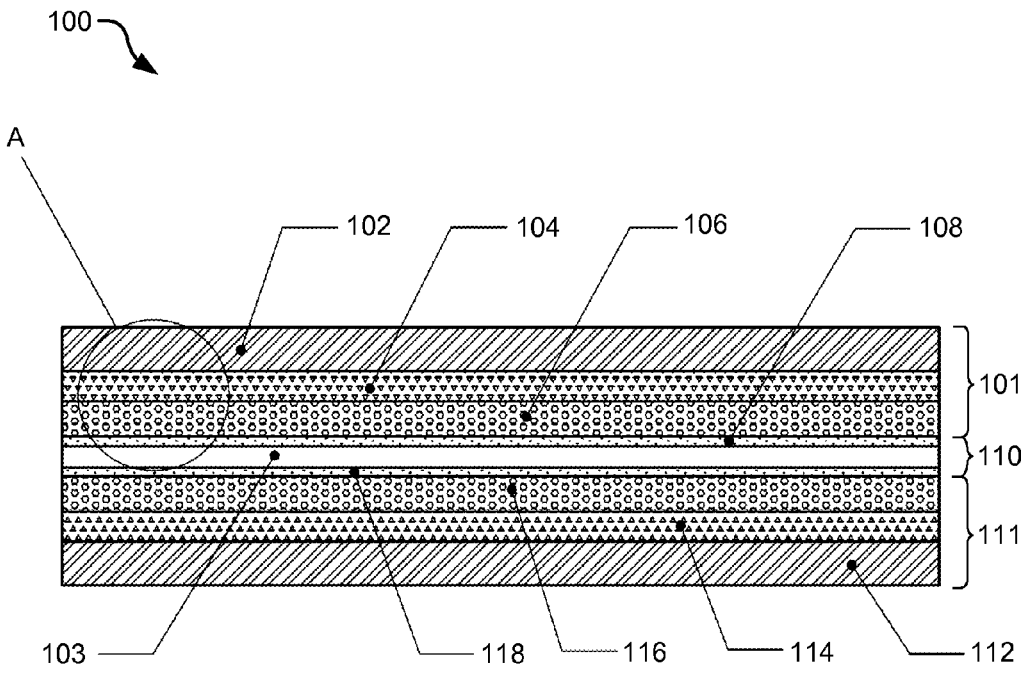
FIG. 1 is a cross-sectional side view of an exemplary X-ray film assembly including a first intensifying screen and a second intensifying screen disposed on opposite sides of an X-ray film according to at least one embodiment.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

The instant disclosure is directed to exemplary X-ray intensifying screens for exposing X-ray film, as well as to X-ray film cassettes and X-ray film assemblies. Such X-ray intensifying screens may be used to facilitate exposure of X-ray films in the presence of X-rays for use in a variety of applications, including various medical and dental applications, without limitation. X-ray intensifying screens, as disclosed herein, may also be used in any suitable industrial applications, without limitation.

Figure 2:
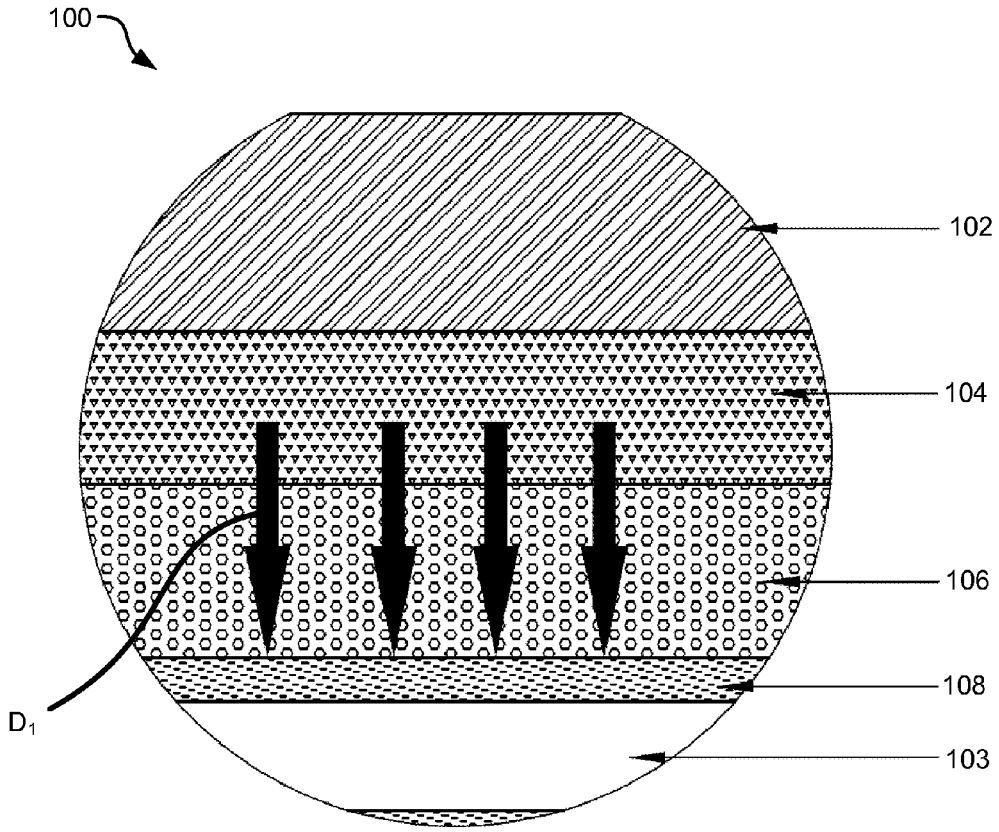
FIG. 2 is a cross-sectional side view of a portion of the exemplary X-ray film assembly illustrated in FIG. 1.

FIGS. 1 and 2 illustrate an exemplary X-ray film assembly 100 that includes a first intensifying screen 101 and a second intensifying screen 111 disposed on opposite sides of an X-ray film 110 according to at least one embodiment. FIG. 2 shows a portion of FIG. 1 that is represented by a circular region labeled A in FIG. 1. As shown in FIGS. 1 and 2, first intensifying screen 101 may comprise a screen support backing 102, a reflective layer 104, and a luminescent layer 106. Second intensifying screen 111 may comprise a screen support backing 112, a reflective layer 114, and a luminescent layer 116. X-ray film 110 may comprise a film base 103 coated with an emulsion layer on one or two sides. For example, as illustrated in FIG. 1, opposite sides of film base 103 may be coated with a first emulsion layer 108 and a second emulsion layer 118. First emulsion layer 108 may be formed on a first side of film base 103 and second emulsion film 118 may be formed on a second side of film base 103.

First and second emulsion layers 108 and 118 may comprise any film layer suitable for producing an image in the presence of light and/or X-rays. For example, first and second emulsion layers 108 and 118 may comprise materials that are sensitive to various wavelengths of light, such as visible light. In some examples, first emulsions layer 108 and/or second emulsion layer 118 may be primarily sensitive to light falling within a particular wavelength range. For example, first emulsions layer 108 and/or second emulsion layer 118 may have a greater sensitivity to light falling within a blue light and/or a green light spectrum. First and second emulsion films 108 and 118 may comprise any suitable material that darkens X-ray film 110 when exposed to visible light, without limitation. In at least one embodiment, emulsion films 108 and 118 may comprise silver halide crystals dispersed in a gelatin material. In various embodiments, first emulsion layer 108 and/or second emulsion layer 118 may be covered by an additional layer on a side opposite to film base 103, such as, for example, a protective coating.

X-ray film 110 may be disposed adjacent to at least one intensifying screen prior to exposure to X-rays. For example, as shown in FIG. 1, X-ray film 110 may be sandwiched between first emulsion layer 108 and second emulsion layer 118 such that first intensifying screen 101 is disposed on a first side of X-ray film 110 adjacent to first emulsion layer 108 and second intensifying screen 111 is disposed on a second side of X-ray film 110 adjacent to second emulsion film 118. Alternatively, an X-ray film, such as an X-ray film having only a single emulsion layer, may be disposed adjacent to only a single intensifying screen.

Each of first intensifying screen 108 and second intensifying screen 118 illustrated in FIG. 1 may comprise any suitable material which exhibits luminescence in response to excitation by X-rays. For example, first intensifying screen 108 and second intensifying screen 118 may each convert X-ray photons into visible light photons having a wavelength suitable for exposing first and second emulsion layers 108 and 118. Luminescent layers 106 and 116 may, for example, comprise a phosphor material. Examples of suitable phosphor materials include, without limitation, rare earth phosphors, such as gadolinium and/or lanthanum phosphors, calcium tungstate phosphors, silver-activated zinc sulfide, copper-activated zinc sulfide, and/or combinations of the foregoing. In various embodiments, luminescent layer 106 may be covered by an additional layer on a side opposite to reflective layer 104, such as a protective coating. Likewise, luminescent layer 116 may be covered by an additional layer, such as a protective coating, on a side opposite to reflective layer 114.

In some embodiments, luminescent layer 106 and/or luminescent layer 116 may emit light falling within a certain wavelength range. For example, luminescent layer 106 and/or luminescent layer 116 may comprise phosphor materials that emit light within a certain portion of the visible light spectrum, such as, for example, blue light and/or green light. First emulsion layer 108 and/or second emulsion layer 118 may comprise materials that are sensitive to wavelengths of light emitted by luminescent layer 106 and/or luminescent layer 116, such as light falling within a blue light and/or a green light spectrum.

Reflective layers 104 and 114 may comprise any suitable material that reflects visible light toward X-ray film 110. In at least one embodiment, reflective layers 104 and 114 may comprise at least one of a polymer material, a crystalline material, such as a glass material, a metallic material, and/or any other suitable material for reflecting light. In some examples, reflective layer 104 and/or reflective layer 114 may be coated with a reflective and/or semi-reflective material. Each of reflective layers 104 and 114 may comprise any suitable reflective surface configuration. For example, reflective layer 104 and/or reflective layer 114 may comprise an array of prisms, such as micro-prisms, configured to retroreflect light emitted by luminescent layer 106 and/or luminescent layer 116. Such micro-prisms may have any suitable configuration, without limitation. In some embodiments, the micro-prisms may be tinted to match the color sensitivity of X-ray film 110 so as to increase film exposure.

Figure 3:
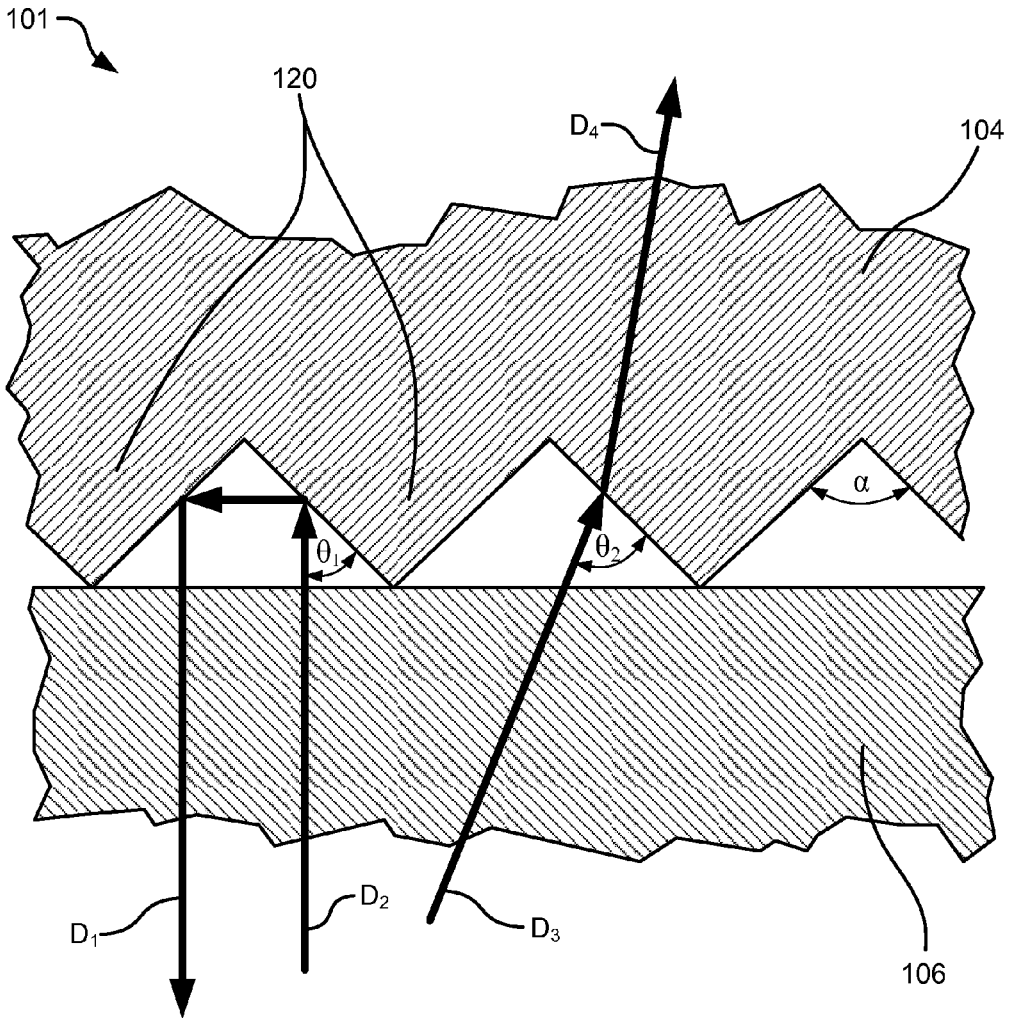
FIG. 3 is a cross-sectional side view of a portion of an exemplary intensifying screen according to at least one embodiment.

FIG. 3 shows a cross-sectional side view of a portion of an exemplary intensifying screen 101 according to at least one embodiment. As illustrated in FIG. 3, intensifying screen 101 may include a luminescent layer 106 and a reflective layer 104 comprising an array of micro-prisms 120. Micro-prisms 120 may be sized, shaped, tinted, and arranged in any suitable manner, without limitation. For example, micro-prisms 120 may be formed in reflective layer 104 to include numerous geometric corners, such as corners defined by surfaces of micro-prisms 120 that are disposed at an angle $\alpha$ of approximately 90° relative to each other, so that light emitted by a luminescent layer in direction $D_2$ strikes one micro-prism 120 surface defining a corner and is reflected toward another adjacent micro-prism 120 defining the corner; the light is then reflected (i.e., retroreflected) generally back toward the light emission source in direction $D_1$.

According to some embodiments, corners defined by surfaces of adjacent micro-prisms 120 may be disposed at an angle $\alpha$ of between approximately 80° and approximately 100° relative to each other. According to additional embodiments, corners defined by surfaces of adjacent micro-prisms 120 may be disposed at an angle $\alpha$ of between approximately 85° and approximately 95° relative to each other. Reflective layer 104 and/or reflective layer 114 may include, for example, a repeating pattern of micro-prisms, such as pyramidal prisms and/or any other suitably-shaped prisms. In some embodiments, reflective layer 104 and/or reflective layer 114 may additionally or alternatively include reflective beads or micro-spheres that retroreflect light back towards its source.

Reflective layer 104 and/or reflective layer 114 may comprise a single material that is molded, etched, machined, and/or otherwise formed to have a surface region comprising the plurality of micro-prisms. In additional embodiments, the micro-prisms may be covered with one or more additional layers of material between the reflective layer and adjacent luminescent layer 106 and/or luminescent layer 116. Alternatively, the micro-prisms formed on reflective layer 104 and/or reflective layer 114 may be respectively disposed directly adjacent to luminescent layer 106 and/or luminescent layer 116 (see, e.g., micro-prisms 120 illustrated in FIG. 3) or may be directly adhered to luminescent layer 106 and/or luminescent layer 116 by an adhesive layer. In additional embodiments, micro-prisms and/or micro-spheres may be individually adhered to and/or embedded within reflective layer 104 and/or reflective layer 114.

According to some embodiments, reflective layer 104 and/or reflective layer 114 may comprise a substantially opaque material that is substantially impermeable to light such that light incident upon reflective layer 104 and/or reflective layer 114 is either reflected or absorbed by reflective layer 104 and/or reflective layer 114. In additional embodiments, reflective layer 104 and/or reflective layer 114 may comprise a material that is semi-permeable or permeable to light. With such a configuration, light incident upon reflective layer 104 and/or reflective layer 114 is either reflected by or passes through reflective layer 104 and/or reflective layer 114. Reflective layer 104 and/or reflective layer 114 may either reflect or refract light based, for example, on the incident angle of light relative to the surface of reflective layer 104 and/or reflective layer 114, respectively.

For example, as illustrated in FIG. 3, light traveling in direction $D_2$ that is obliquely incident upon a micro-prism 120 surface of reflective layer 104 may be retroreflected in direction $D_1$ if it impinges on the surface at an angle $\theta_1$ from the surface that is below a critical angle measured from the surface. Conversely, if the light traveling in direction $D_3$ impinges upon a micro-prism 120 surface of reflective layer 104 at an angle $\theta_2$ from the surface that is above the critical angle measured from the surface, the light may be refracted in direction $D_4$ and pass through at least a portion of reflective layer 104. Therefore, in reflective layer 104 comprising the array of micro-prisms 120 as illustrated in FIG. 3, light that is emitted from luminescent layer 106 may either be reflected or refracted based on the angle at which the light strikes the micro-prism 120 surfaces.

Accordingly, light that is emitted in a direction that is generally perpendicular to surfaces of luminescent layers 106 and 116 facing X-ray film 110, and/or facing an adjacent reflective layer 104 or 114, may strike surfaces of micro-prisms of reflective layer 104 and/or a reflective layer 114 at angles that are less than the critical angle as measured from the surfaces of the micro-prisms; accordingly, the light may be retroreflected by the micro-prisms generally back toward the emission source of the light in luminescent layer 106 and/or luminescent layer 116 and toward X-ray film 110. As illustrated, for example, in FIGS. 2 and 3, light may be retroreflected by reflective layer 104 in direction $D_1$ toward emulsion layer 108 of X-ray film 110.

On the other hand, light that is emitted from luminescent layer 106 and/or luminescent layer 116 in a direction that is not generally perpendicular to surfaces of luminescent layers 106 and 116 facing X-ray film 110, and/or facing an adjacent reflective layer 104 or 114, may strike surfaces of micro-prisms of reflective layer 104 and/or a reflective layer 114 at angles that are greater than the critical angle as measured from the surfaces of the micro-prisms; accordingly, the light may be refracted by and pass through the micro-prisms such that the light is not directed back toward X-ray film 110. Accordingly, light may be more effectively reflected toward X-ray film 110 while reducing the amount of scattered light incident upon X-ray film 110.

By using an X-ray film assembly having one or more intensifying screens including a reflective layer with micro-prisms, as described herein, images may be produced on X-ray film 110 using lower amounts of radiation while increasing the sharpness, clarity, and detail of the image produced. As such, patients and medical workers may be exposed to lower amounts of radiation. Additionally, wear and tear on X-ray tubes and other equipment used to produce X-rays may be reduced.

In some embodiments, reflective layer 104 and/or reflective layer 114 may comprise a material that is semi-permeable or permeable to light, allowing refracted light to pass through at least a portion of reflective layer 104 and/or reflective layer 114. In additional embodiments, a light-absorbing layer may be disposed on a side of the plurality of micro-prisms of reflective layer 104 and/or reflective layer 114 opposite the respective adjacent luminescent layer 106 or 116. A light-absorbing layer may comprise a low-reflectance material, such as a dark or black material, that absorbs the majority (e.g., greater than 80% or greater than 90%) of incident light. In certain embodiments, at least a portion of reflective layer 104 and/or reflective layer 114 may comprise a light-absorbing material. In additional embodiments, support backing 102 and/or support backing 112 may comprise a light-absorbing material and/or a separate light-absorbing layer may be disposed between reflective layer 104 and/or reflective layer 114 and adjacent support backing 102 or 112. Accordingly, light that is refracted and passes through at least a portion of reflective layer 104 and/or reflective layer 114 may be absorbed so as to prevent scattered light from being reflected back toward X-ray film 110, thereby increasing the image sharpness, detail, and clarity.

Figure 4:
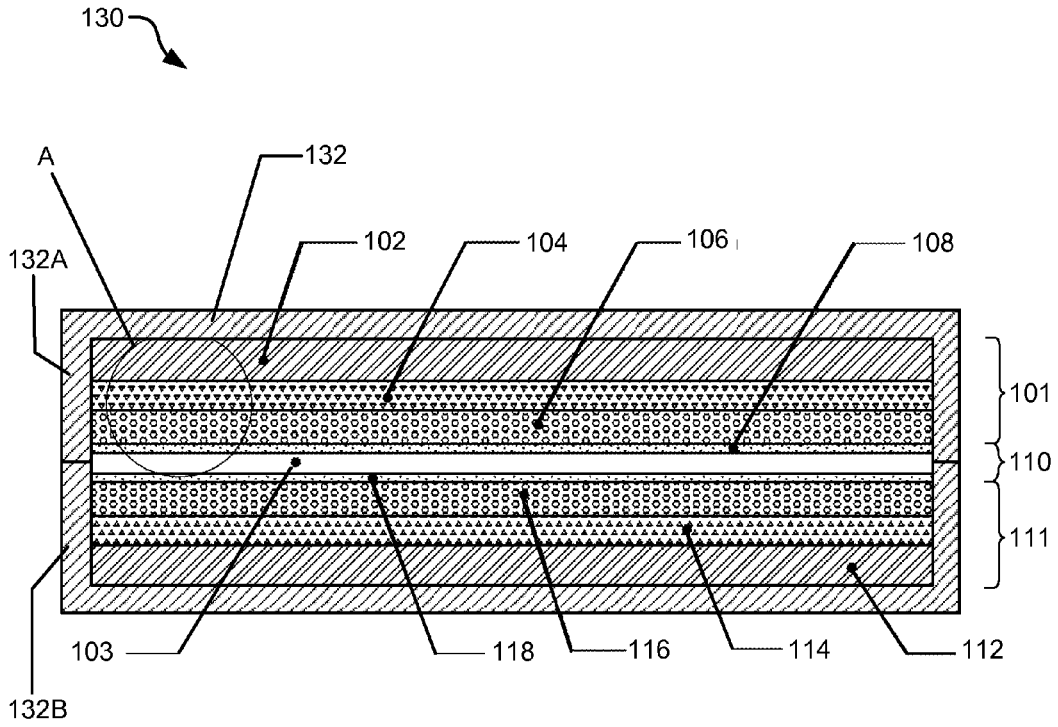
FIG. 4 is a cross-sectional side view of a portion of exemplary X-ray film cassette including a first intensifying screen and a second intensifying screen disposed on opposite sides of an X-ray film according to at least one embodiment.

FIG. 4 illustrates an exemplary X-ray film cassette 130 comprising a first intensifying screen 101 and a second intensifying screen 111 disposed on opposite sides of an X-ray film 110 according to at least one embodiment. As shown in FIG. 4, X-ray film cassette 130 includes a light-proof housing 132 and at least one intensifying screen that is surrounded by housing 132. For example, X-ray film cassette 130 may include a first intensifying screen 101 and a second intensifying screen 111. As shown in FIG. 4, first and second intensifying screens 101 and 111 may be disposed on opposing inner surfaces of housing 132. According to at least one embodiment, X-ray film cassette 130 may include a first housing portion 132A adjacent first intensifying screen 101 and a second housing portion 132B adjacent second intensifying screen 111. X-ray film cassette 130 may be configured to hold an X-ray film 110 between first intensifying screen 101 and a second intensifying screen 111. Further to this end, X-ray film cassette 130 may be opened such that first housing portion 132A and first intensifying screen 101 are separated from second housing portion 132B and second intensifying screen 111, allowing X-ray film 110 to be loaded into and removed from X-ray film cassette 130.

The preceding description has been provided to enable others skilled in the art to best utilize various aspects of the exemplary embodiments described herein. This exemplary description is not intended to be exhaustive or to be limited to any precise form disclosed. Many modifications and variations are possible without departing from the spirit and scope of the instant disclosure. It is desired that the embodiments described herein be considered in all respects illustrative and not restrictive and that reference be made to the appended claims and their equivalents for determining the scope of the instant disclosure.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising."

What is claimed is:

1. An intensifying screen for exposing X-ray film, the intensifying screen comprising:

a screen support backing;

a luminescent layer including a luminescent material that emits light in the presence of X-rays;

a reflective layer disposed between the luminescent layer and the screen support backing, the reflective layer including a plurality of micro-prisms that reflect light emitted by the luminescent material, wherein micro-prism surfaces of the plurality of micro-prisms do not reflect light that impinges on the respective micro-prism surfaces at an angle exceeding a critical angle as measured from the respective micro-prism surfaces.

2. The intensifying screen according to claim 1, wherein the reflective layer is configured to reflect light emitted by the luminescent material toward an X-ray film disposed adjacent to the luminescent layer.

3. The intensifying screen according to claim 1, wherein the reflective layer reflects light in a direction generally perpendicular to a surface of the screen support backing facing the reflective layer.

4. The intensifying screen according to claim 1, wherein the reflective layer reflects light in a direction generally perpendicular to a surface of the luminescent layer facing the reflective layer.

5. The intensifying screen according to claim 1, wherein the luminescent layer emits visible light in response to excitation by X-rays.

6. The intensifying screen according to claim 1, wherein the luminescent material comprises a phosphor material.

7. The intensifying screen according to claim 1, wherein the reflective layer comprises a polymer material.

8. The intensifying screen according to claim 1, wherein the reflective layer comprises a crystalline material.

9. The intensifying screen according to claim 1, wherein the reflective layer comprises a glass material.

10. The intensifying screen according to claim 1, further comprising a light-absorbing layer on a side of the plurality of micro-prisms opposite the luminescent layer.

11. The intensifying screen according to claim 1, wherein the screen support backing comprises a light-absorbing layer.

12. An X-ray film cassette comprising:

at least one intensifying screen according to claim 1;

a housing surrounding the at least one intensifying screen.

13. The X-ray film cassette according to claim 12, wherein the X-ray film cassette includes two intensifying screens disposed on opposing inner surfaces of the housing.

14. An X-ray film assembly comprising:

at least one intensifying screen according to claim 1;

an X-ray film.

15. The X-ray film assembly according to claim 14, wherein the X-ray film is disposed between two intensifying screens.

16. The X-ray film assembly according to claim 14, wherein the X-ray film has an emulsion layer.

17. The intensifying screen according to claim 1, wherein the micro-prism surfaces reflect light that impinges on the respective micro-prism surfaces at an angle that is less than the critical angle as measured from the respective micro-prism surfaces.

18. The intensifying screen according to claim 1, wherein the micro-prism surfaces reflect light that impinges on the respective micro-prism surfaces at an angle that is less than the critical angle as measured from the respective micro-prism surfaces.

19. The intensifying screen according to claim 1, wherein light impinging on the micro-prism surfaces that is not reflected is refracted and passes through at least a portion of the reflective layer.

* * * * *